United States Patent [19]

Rayborn

[11] Patent Number: 4,964,820

[45] Date of Patent: Oct. 23, 1990

[54] TROLLING MOTOR FOOT CONTROL MOUNTING SYSTEM

[76] Inventor: William L. Rayborn, 3300 Bugle Dr., Pine Bluff, Ark. 71603-8228

[21] Appl. No.: 429,034

[22] Filed: Oct. 30, 1989

[51] Int. Cl.[5] ..... B63H 25/02

[52] U.S. Cl. ..... 440/7; 114/144 A; 74/480 B

[58] Field of Search ..... 440/6, 7; 114/144 R, 114/144 RE, 363; 74/478, 480 B, 481, 512, 560

[56] References Cited

U.S. PATENT DOCUMENTS

| | | | |
|---|---|---|---|
| 4,195,588 | 4/1980 | Hudson | 114/144 A |
| 4,527,983 | 7/1985 | Booth | 440/7 |
| 4,597,356 | 7/1986 | McGaghrer et al. | 440/7 |
| 4,728,307 | 3/1988 | Burgess | 440/7 |

*Primary Examiner*—Joseph F. Peters, Jr.
*Assistant Examiner*—Jesûs D. Sotelo
*Attorney, Agent, or Firm*—Stephen D. Carver

[57] ABSTRACT

A system for rotatably mounting foot operated trolling motor controls flushly within boat decks. The system is mounted within a suitable orifice defined in the boat deck, so that the fisherman may conveniently rotate his foot control to a desired angle, while maintaining both feet in a comfortable, level position. A rigid frame fastened within the deck extends downwardly into the mounting orifice for recessed operation. A plurality of radially spaced apart brackets fasten the frame to the deck. A rotatable, substantially cylindrical pan is flush mounted within the frame interior, and coupled to the bracket system with a suitable bearing for subsequent rotation. The pan has a generally circular interior, which receives and mounts the foot control system. The fisherman's trolling motor foot control is disposed and centered within the interior of the rotatable pan, braced by a pair of spacers having a generally segment-shaped cross section. The spacers center the foot control appropriately within the pan, and the foot control may thus be rotated by the fisherman from a convenient, recessed position. Since the foot control is recessed, the fisherman's balance is preserved. A cover may be deployed in substantially coplanar relation to the boat deck when the trolling motor is not used.

20 Claims, 4 Drawing Sheets

FIG. 5
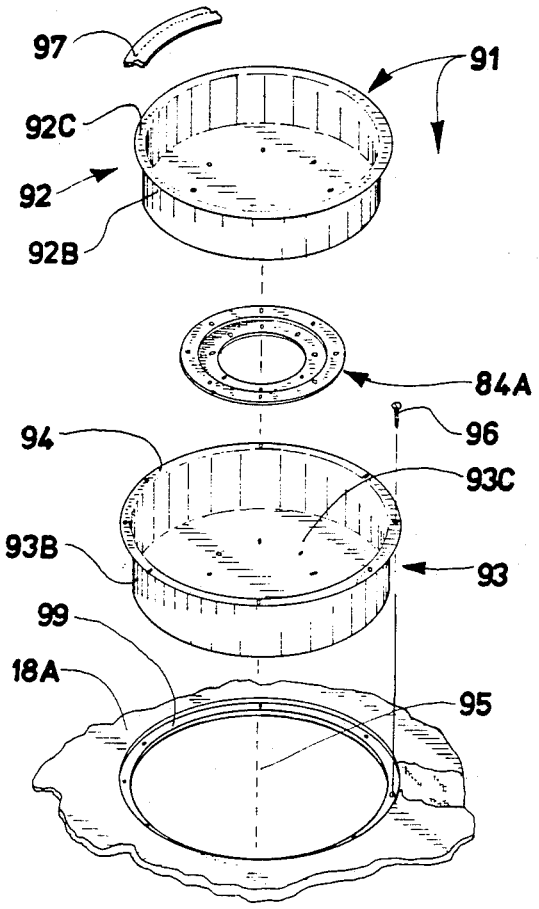
FIG. 7
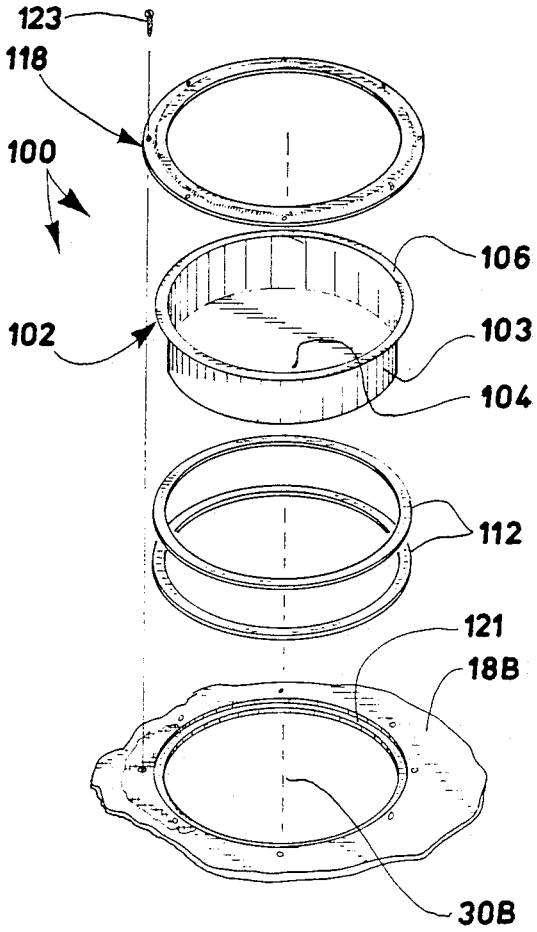
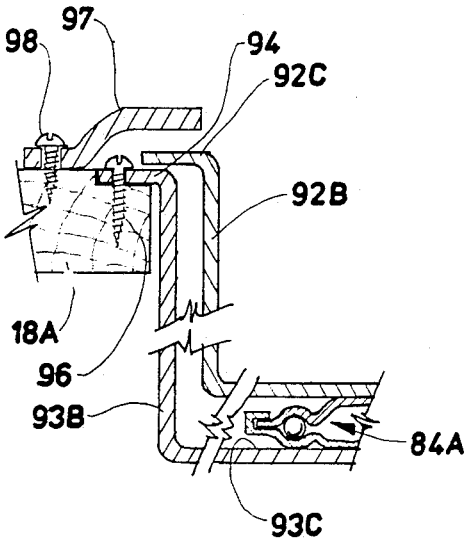
FIG. 6
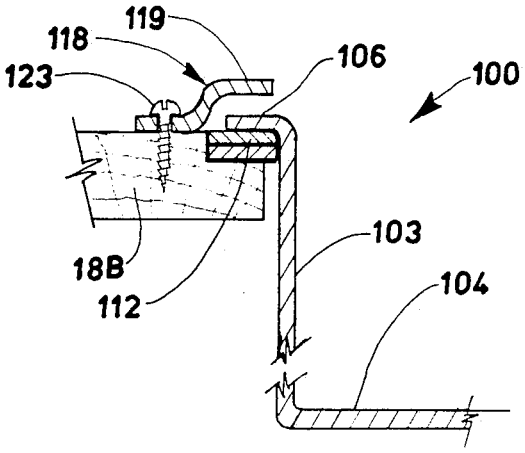
FIG. 8

TROLLING MOTOR FOOT CONTROL MOUNTING SYSTEM

BACKGROUND OF THE INVENTION

The present invention relates generally to electric trolling motor controls for fishing boats. More particularly, the present invention is directed to a foot control mounting system, ideally for use by fishermen, which flush mounts the conventional trolling motor foot pedal, and which selectively facilitates level, foot operated rotation and manipulation thereof.

In the prior art a wide variety of electric trolling motors or auxiliary propulsion motors are known for fishing. As will be well recognized by those skilled in the art, electric trolling motors are ideal for quietly propelling the fishing boat through the water. Many simple maneuvers are thus facilitated during fishing, without requiring activation of the gasoline powered outboard motor. Numerous trolling motors exist, and they are associated with a wide variety of foot control systems. A typical foot control includes a rocking pedal which is entirely foot operated, and the foot control apparatus usually projects above the deck of the boat. Thus, when a fisherman is standing on the deck and operating the foot control, one foot must be higher than the other. As a result, the fisherman may assume an uncomfortable and awkward position. When, for example, the boat unexpectedly strikes an underwater obstacle, the fisherman may stumble or fall. If one is to stand in a boat at all, it is highly desirable to assume a comfortable and stable stance.

The prior art reflects numerous systems for mounting or controlling trolling motor foot pedal assemblies. A rotary system which can arc around a typical chair disposed on the boat deck is seen in U.S. Pat. No. 4,597,356, issued July 1, 1986. Another rotation system is disclosed in U.S. Pat. No. 4,722,706, issued Feb. 2, 1988. This base includes a receptacle adapted to receive the foot control pedal associated with a trolling motor, and the apparatus can rotate around the base of the chair, so that it can be conveniently moved to preselected positions, while still being axially restrained. An electric trolling motor foot control mount is also seen in U.S. Pat. No. 4,702,713, issued Oct. 27, 1987. The latter device includes a base member secured to the boat deck and a pedal pivotally mounted to it. However the base member is in turn captivated upon a rotatable plate for rotation about a limited arc over the boat deck, so that the pedal system can be moved to a variety of positions. It is axially secured to prevent it from rolling off or escaping from the boat deck.

The closest prior art known to me is U.S. Pat. No. 4,728,307, issued to Burgess on Mar. 1, 1988. Thereshown is an electric trolling motor which is journaled for rotation by a rotatable shaft projecting through the hull all the way into the water. A disk on the motor control shaft is received within a suitable recess in the hull of the boat, so that motor control can be effectuated by foot movement upon a rotatable disk. In other words, the operator of this motor can effectively steer the boat with his foot by contacting the rotatable disk disposed within the boat. Since the disk is essentially flush mounted the user can control the apparatus without unbalancing himself.

However, I have found that disk type controllers are difficult to operate when, for example, a large game fish is hooked and the inevitable excitement occurs. Most experienced fishermen can control the foot control pedal by "touch" or "feel" without looking at it. As the fishermen becomes familiar with his or her pedal, an intuition as to how the foot pedal control apparatus should feel and work in actual operation is developed. Most fisherman grow accustomed to the "feel" of their equipment, and they thus prefer not to change or replace their equipment. However, I have found that most fishermen would prefer a recessed, flush mounted pedal, which can rotate as necessary to generally face the action. Hence I have found it best to employ the conventional type of foot control pedal which is associated with conventional electric trolling motors.

In other words, it is important to enable the fisherman to use his standard foot control, which can impart a feeling of confidence to the user. A rotatable mounting system is desirable, but the apparatus should not require the user to become unbalanced. Further, the top of such a system must be substantially coplanar with the boat deck. Importantly, installation of the apparatus should be easy and non-destructive. It must not require any penetration of the hull of the boat. Finally, an acceptable system must provide some form of cover, which lies coplanar with the deck, so that when the trolling motor is not being used, a continuous smooth boat deck surface free of obstructions results.

SUMMARY OF THE INVENTION

The present invention comprises a rotatable system for flush mounting a foot operated control for a conventional trolling motor. Ideally the system is rotatably disposed within a suitable orifice defined in the boat deck, so that the fisherman may conveniently rotate his foot controls to a desired position, while maintaining both feet in a comfortable, level position.

In the preferred embodiment of the invention, a rigid frame is centered and fastened within an orifice defined in the boat deck. The frame extends downwardly into the orifice, for recessed operation. A plurality of radially spaced apart brackets fasten the frame to the deck. A rotatable, substantially cylindrical pan is fitted within the frame. It is flush mounted within the frame interior, and coupled to the bracket system with a suitable bearing for subsequent rotation. The pan has a generally circular interior, which receives and mounts the foot control system.

The fisherman's trolling motor foot control is disposed and centered within the interior of the rotatable pan. It is braced by a pair of spacers having a generally segment-shaped cross section. The spacers center the foot control appropriately within the pan, and the foot control may thus be rotated by the fisherman from a convenient, recessed position. Since the foot control is recessed, the fisherman's balance is preserved.

An optional cover plate may be fitted over the rotatable pan to cover the foot control. The spacers each include a peripheral groove defined upon their sides, and edges of the cover plate are nested within these grooves. The cover plate may be installed to block the interior of the pan when the trolling motor foot control is removed (i.e. it is not being used.) Thus the cover insures a level deck. Or the cover may be fastened over the foot control simply to protect it when not in use.

In an alternative embodiment the frame is comprised of a stationary pan having a radial lip fastened directly to the periphery of the orifice. The lower surface of the latter pan receives a separate, rotatable pan which is concentrically mounted upon a suitable bearing system. In yet another embodiment, a single lipped pan arrangement is employed, and its lip rides over a radially disposed bearing fitted within an offset at the periphery of the boat deck orifice.

Thus a basic object of the present invention is to provide a foot control mounting assembly for conventional electric trolling motors which can be used by the fisherman while keeping both feet level.

Another fundamental object of the present invention is to enable a conventional trolling motor foot control system to be oriented in a plurality of desired, operational positions.

A similar object is to facilitate a plurality of trolling motor foot control orientations without unbalancing the fisherman.

Yet another object of the present invention is to provide a foot control mounting system of the character described which may be employed in conjunction with a wide variety of boats and trolling motors.

Another fundamental object of the present invention is to provide a trolling motor foot control mounting system for fishermen which may be easily and safely installed with a minimum of damage to the boat.

A similar fundamental object is to provide a trolling motor foot control mounting system which may be installed without cutting the critical boat hull.

Yet another object of the present invention is to provide a mounting system of the character described which need not be constantly observed when in use.

Another object of the present invention is to enhance the fisherman's comfort and control while maneuvering the boat.

A further object of the present invention is to provide a mounting system which can be easily covered when the boat is used for purposes other than fishing. A feature of my invention is that when the cover is installed, it will be substantially coplanar with the boat deck, freeing the floor from obstructions and protecting the unused foot control.

These and other objects and advantages of the present invention, along with numerous features thereof, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views:

FIG. 5 is a fragmentary exploded view similar to FIG. 4, but illustrating an alternative embodiment;

FIG. 6 is a fragmentary, enlarged, sectional view showing a portion of the second embodiment, with portions thereof broken away and shown in section for clarity or omitted for brevity;

FIG. 7 is a fragmentary, exploded view of a third embodiment, with portions thereof omitted for brevity or shown in section for clarity; and, FIG. 8 is a fragmentary, sectional view of the third embodiment of FIG. 7.

DETAILED DESCRIPTION

Figure 1:
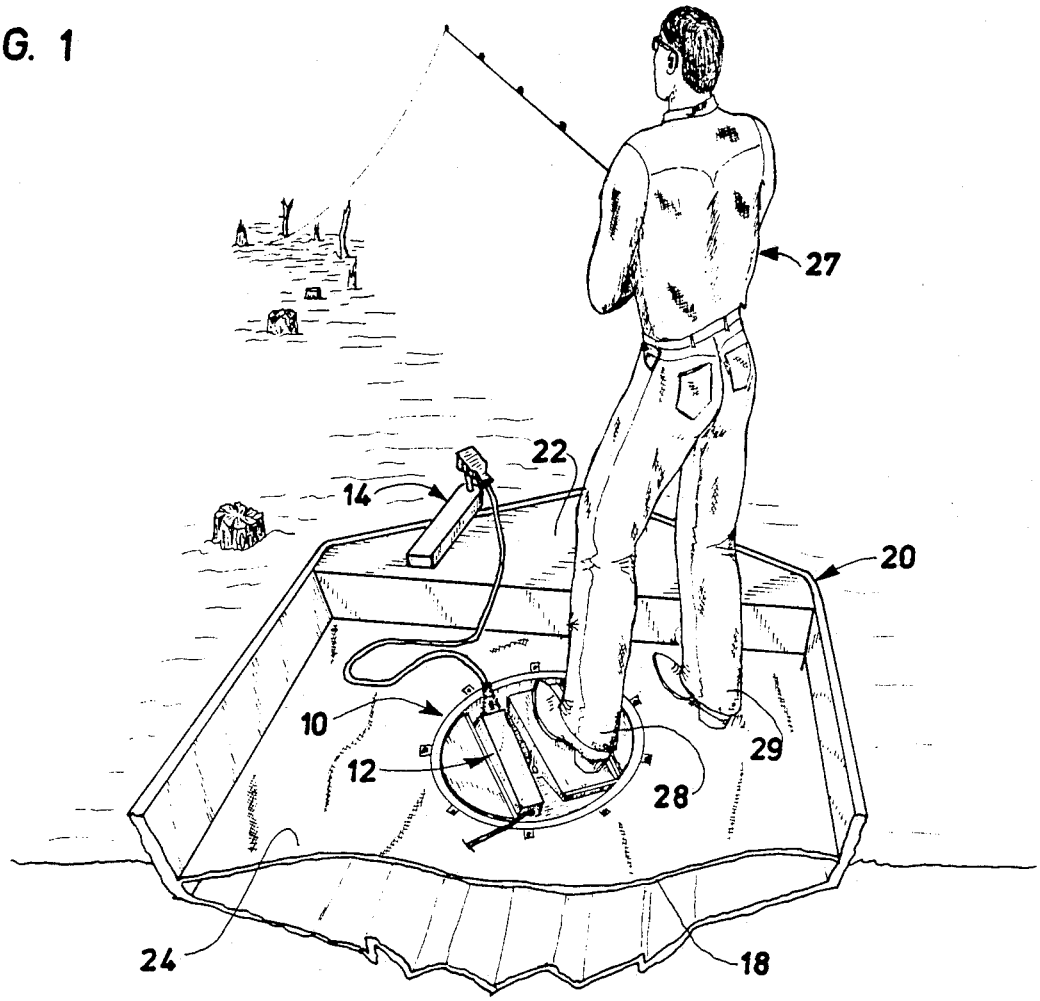
FIG. 1 is a fragmentary, pictorial view illustrating my TROLLING MOTOR FOOT CONTROL MOUNTING SYSTEM installed upon a conventional boat deck, with one foot of the fisherman shown disposed upon a conventional trolling motor foot control.
Figure 2:
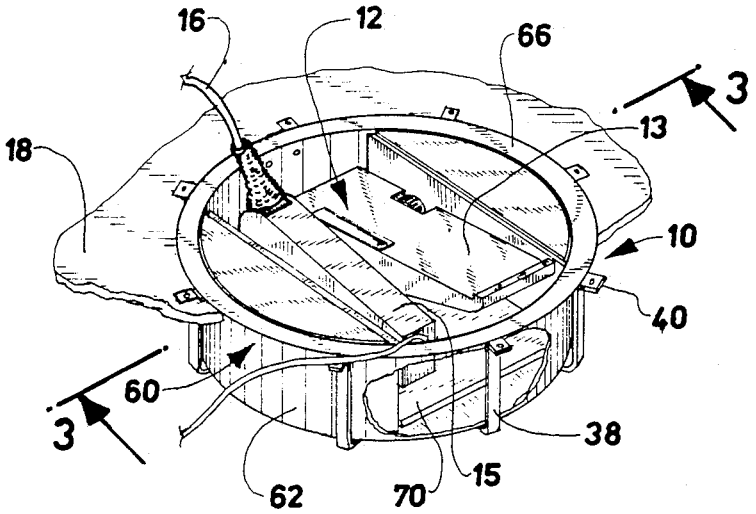
FIG. 2 is an enlarged, fragmentary, sectional view of my TROLLING MOTOR FOOT CONTROL MOUNTING SYSTEM, with portions thereof broken away or show in section for clarity.
Figure 1A:
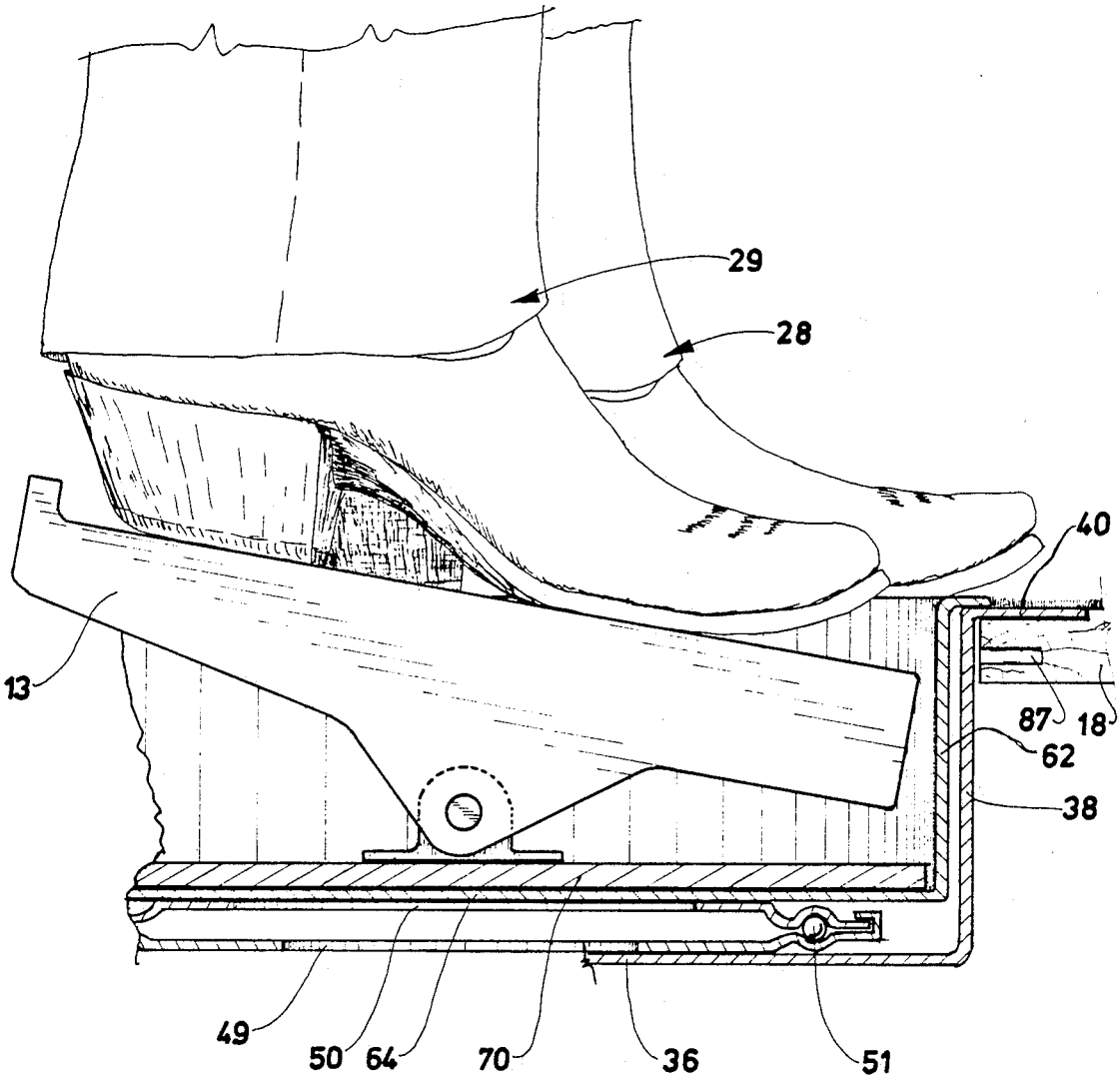
FIG. 1A is an enlarged, fragmentary plan view showing the feet of the fisherman in a moved position from FIG. 1 when my TROLLING MOTOR FOOT CONTROL MOUNTING SYSTEM is in use, with portions thereof broken away or shown in section for clarity.

With initial reference now directed to FIGS. 1, 1A and 2 of the appended drawings, my TROLLING MOTOR FOOT CONTROL MOUNTING SYSTEM has been generally designated by the reference numeral 10. My mounting system 10 secures the conventional foot control system 12 of a typical electric trolling motor 14 for easy, rotatable flush mounted use. Foot control system 12 may include an inclined, pivoting pedal 13 for foot operation, and an associated cable control member 15, which mounts cable 16. As will be recognized by those skilled in the art, a wide variety of foot controls 12 exist, and they may be linked to the trolling motor 14 through a variety of different types of cables or linkages 16.

System 10 is mounted within a suitable orifice 30 which has been pre-defined within the deck 18 of the conventional fishing boat 20. Of course boat 20 may take on a variety of configurations, and the trolling motor 14 may be mounted either on the bow 22 or the stern (not shown). As illustrated, deck 18 is covered with a suitable fabric rug 24. Through use of this system the fisherman 27 may stand comfortably upon the boat deck 18 with both of his feet 28, 29 substantially level with one another. As best viewed in FIG. IA, as the fisherman moves about the boat deck, his feet may be maintained in a substantially level position, with foot 29 disposed upon the boat deck 18, and with foot 28 disposed upon the pedal 13 associated with the foot control system 12.

Figure 3:
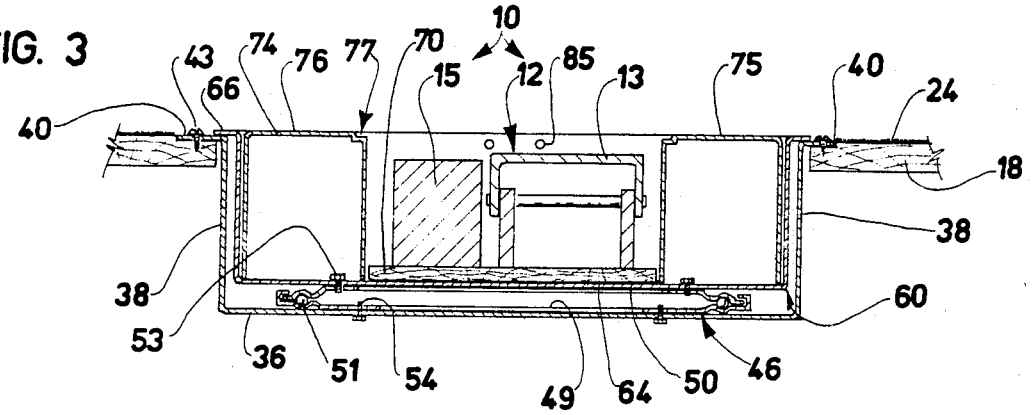
FIG. 3 is an enlarged, fragmentary, sectional view taken generally along line 3-3 of FIG. 2, with portions thereof broken away or omitted for clarity.
Figure 4:
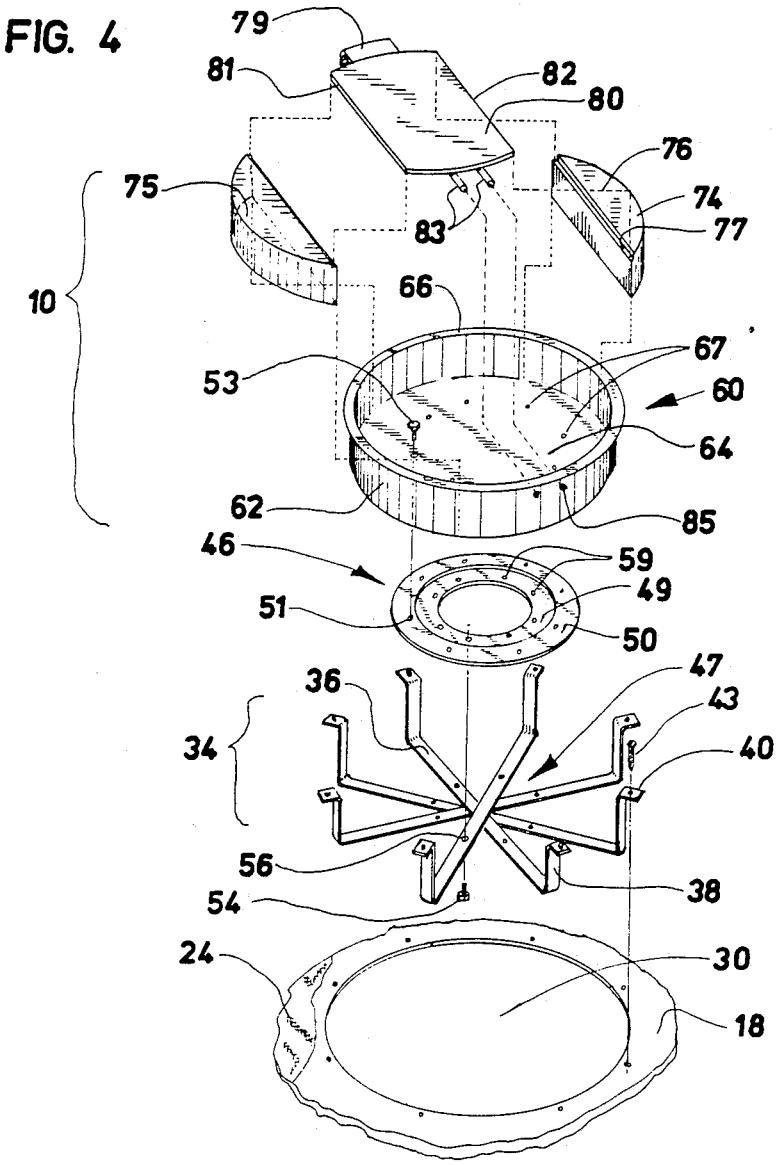
FIG. 4 is an fragmentary, exploded view, of the mounting system, with portions thereof broken away or omitted for clarity.

With reference now directed to FIGS. 3 and 4, the mounting system 10 is adapted to be installed within a round orifice 30 which must be cut within the boat deck 18 by the installer. A rigid, generally spider-like frame has been generally designated by the reference numeral 34. Frame 34 comprises a plurality of radially spaced apart brackets 36, each one of which includes an offsetting vertical portion 38 terminating in a horizontal tab member 40. As best viewed in FIG. 3, each of the tabs 40 are fastened to the boat deck 18 with a suitable screw 43. The frame members 36 are secured together when a bearing assembly, generally designated by the reference numeral 46, is secured approximately at the center 47 of the frame.

Bearing assembly 46 is preferably a Lazy-Susan brand turntable available from Triangle Manufacturing, of Oshkosh, Wis. It includes a lower plate 49 rotatably secured to an upper plate 50 by a concentric, bearing/-race assembly 51. Lower plate 49 is directly bolted to the frame 36 with suitable screws 54 received through orifices 56 defined in the frame members 36. As viewed in FIG. 3, the frame 34 is preferably mounted upon the boat deck 18, with its horizontal tabs 40 disposed on top of deck 18 beneath the rug 24. Alternatively it may be mounted below the boat deck, Orifices 59 and bearing plate 49 must be aligned with orifice 56 and frame 36.

A rotatable pan, generally designated by the reference numeral 60, is rotatably coupled to the frame 34 by turntable bearing 46. Pan 60 includes a generally tubular wall 62 extending between an interior surface 64 and an upper peripheral lip 66. A plurality of radially spaced apart orifices 67 defined in the surface 64 are adapted to be aligned with radially spaced apart orifices 51 within bearing plate 50 to fasten the pan to the bearing 46 with suitable screws 53. The foot control system 12 is secured to the pan. As best seen in FIG. 3, this conventional foot control assembly 12 includes a support plate 70, usually of metal or plastic. Plate 70 rest directly upon pan surface 64 interiorly of the rotatable, lipped pan 60. Preferably it is braced by a pair of spacers 74, 75 (FIG. 4). Each of the spacers 74, 75 have a cross section generally in the form of a segment of a circle, and they are preferably riveted to the pan. Each includes a top 76 which will be substantially coplanar with the boat deck. When the spacers are properly installed, a substantially continuous, generally planar work surface will result. Since the spacer tops 76 will be substantially coplanar with the boat deck, dependable footing for the fisherman is insured. Each spacer also includes a recessed ledge 77 which will be oriented generally parallel with and spaced apart from the foot control assembly 12.

As best seen in FIG. 4, an optional cover plate 80 may be installed to cover the rotatable pan. It includes a pair of spaced apart edges 81 and 82 which are adapted to be received and seated within the spacer ledges 77. A pair of rearwardly projecting prongs 83 penetrate orifices 85 defined in the sidewall 62 of pan 60 and the aligned orifices 87 in the boat deck (FIG. 1A) to secure the cover plate 80. Latch 79 may be secured to pan lip 66 to further brace the cover plate 80. Prongs 83 prevent the assembly from turning when fitted to orifices 87. When installed, the cover plate is substantially coplanar with the spacer tops and the boat deck, so an unobstructed surface results. In other words, the pan can be covered, whether or not the foot control is inside, and the occupants of the boat will have a level unobstructed deck. Therefore the foot control can be hidden away when the trolling motor is not in use.

With reference now to FIGS. 5 and 6, an alternative embodiment of my foot control mounting system has been generally designated by the reference numeral 91. System 91 includes a rotatable pan generally designated by the reference numeral 92, which is similar to pan 60 previously discussed. It includes tubular body 92B and an upper, outwardly turned lip portion 92C. However, a stationary, lipped pan, generally designated by the reference numeral 93, replaces the frame 34 previously described. Pan 93 includes a rigid tubular body 93B which coaxially surrounds inner circular pan surface 93C and terminates in an outwardly turned peripheral lip 94. Lip 94 takes the place of tabs 40 and frame 34 previously discussed. Pan 92 is concentrically mounted within pan 93, upon bearing 84A.

As best viewed in FIG. 6, lip 94 is received within a peripheral, concentric, recessed ledge 99 defined in the periphery of mounting hole 95 in deck 18A, being secured with suitable wood screws 96. Bearing assembly 84A, which is identical to bearing assembly 46 previously discussed, is fastened to pan surface 93C and the underside of pan 92, so pan 92 will rotate. A pair of spacers such as spacers 75 and 76 may be disposed interiorly of pan 92 in the manner previously described, to suitably mount the trolling motor foot control system. Of course it should be appreciated that the spacers will be configured as desired to mate the apparatus with the desired foot control system. For smaller foot controls, larger spacers are required. Preferably, a circumferential cap 97 is secured to the deck concentrically relative to orifice 95 and pans 92, 93 by suitable wood screws 98. When pan 92 rotates, its lip 92C will be protected between lip 94 of the stationary pan 93 and the cover 97.

Turning now to FIGS. 7 and 8, another alternative system has been generally designated by the reference numeral 100. System 100 comprises a single rotatable pan, generally designated by the reference numeral 102, which includes a tubular wall 103 extending between the bottom interior surface 104 of the pan and a radially projecting lip 106, similar to lips 92C and 94 previously described. System 100 is mounted within an orifice 30B precut within the deck 18B, and the tubular wall 103 will concentrically fit downwardly within the orifice. A circumferential bearing assembly 112 fits upon the boat deck concentrically around orifice 30B within ledge 121. Assembly 112 preferably comprises a conventional ball bearing assembly. Preferably, a circumferential cover 118 is secured to the deck 18B with wood screws 123, in concentric relation to orifice 30B. It includes a radially peripherally extending lip 119 which guards the rotatable lip 106 of pan 102.

The conventional foot pedal assembly 12 will be mounted within pan 102 upon surface 104, and the supporting surface 70 of the foot control system will rest directly upon the inner surface 104, to which it may be attached with suitable screws. Moreover, a pair of spacers similar to spacers 75, 76 may be employed interiorly of the pan to locate the foot control system, and an optional cover similar to cover 80 may be additionally employed.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A system for rotatably mounting a conventional trolling motor foot control within a fishing boat, said system comprising:

a frame adapted to be mounted within an orifice defined in the deck of said boat, said frame comprising a lower supporting surface recessed below said deck when the frame is mounted and means for coupling the frame to said deck;

a rotatable pan generally concentrically associated with said frame, said pan having an interior recessed surface for receiving said trolling motor foot control;

bearing means for rotatably coupling said pan to said frame lower surface; and, means for securing said foot control within said pan.

2. The mounting system as defined in claim 1 wherein said means for securing said foot control within said pan comprises a pair of spaced apart, cooperating spacers having a segment shaped cross section adapted to be placed on opposite sides of said foot control to center said foot control within said pan.

3. The mounting system as defined in claim 2 wherein said spacers comprise an upper surface adapted to be disposed in generally coplanar relation with said boat deck, to provide the fisherman with a substantially continuous level surface.

4. The mounting system as defined in claim 3 further comprising plate means removably associated with said pan for at least temporarily covering said foot control and for preventing rotation of said rotatable pan.

5. The mounting system as defined in claim 4 wherein said spacers comprise an offset ridge defined in said upper surface adapted to receive edges of said plate means so that when said plate means is installed, said plate means forms a substantially continuous, smooth surface with said boat deck.

6. The mounting system as defined in claim 5 wherein said means for coupling said frame to the deck comprises a plurality of radially spaced apart brackets adapted to be fastened to said deck.

7. The mounting system as defined in claim 1 wherein said means for coupling said frame to the deck comprises a plurality of radially spaced apart brackets comprising intersecting, generally planar horizontal portions defining said lower supporting surface of said frame and radially spaced apart tab portions adapted to be fastened to said deck.

8. A mounting system for a trolling motor foot control, said mounting system comprising:

a stationary pan adapted to be secured within an orifice defined in the deck of a boat, said stationary pan having a lower supporting surface recessed below said deck when said system is installed and a radial, peripheral lip adapted to be fastened to said deck;

a rotatable pan concentrically received within said stationary pan, said rotatable pan having an interior adapted to receive said trolling motor foot control;

bearing means for rotatably coupling said rotatable pan to said lower supporting surface within said stationary pan; and, means for securing said foot control within said rotatable pan.

9. The mounting system as defined in claim 8 wherein said means for securing said foot control within said rotatable pan comprises a pair of spaced apart, cooperating spacers having a segment shaped cross section adapted to be placed on opposite sides of said foot control to center said foot control within said rotatable pan.

10. The mounting system as defined in claim 9 further comprising plate means removably associated with said rotatable pan for at least temporarily covering said foot control and for preventing rotation of said pan.

11. The mounting system as defined in claim 9 wherein said spacers comprise an upper surface adapted to be disposed in generally coplanar relation with said boat deck, to provide the fisherman with a substantially continuous level surface.

12. The mounting system as defined in claim 11 further comprising plate means removably associated with said rotatable pan for at least temporarily covering said foot control, and wherein said spacers comprise an offset ridge defined in said upper surface adapted to receive edges of said plate means so that when said plate means is installed, said plate means forms a substantially continuous, smooth surface with said boat deck and said upper surfaces of said spacers.

13. The mounting system as defined in claim 12 wherein said rotatable pan comprises a peripheral lip operatively spaced apart from said stationary pan, and said system comprises guard means for substantially covering both peripheral lips.

14. A mounting system for a trolling motor foot control, said system adapted to be mounted within a predefined orifice in the boat deck and the system comprising:

bearing means extending about the periphery of said orifice;

a rotatable pan adapted to be concentrically disposed within said orifice, said pan having an interior adapted to receive said trolling motor foot control, and said pan comprising an outer, upper peripheral lip adapted to be disposed upon said bearing for rotation within said orifice, and said pan having a lower supporting surface recessed below said deck when said system is mounted; and, means for securing said foot control within said rotatable pan upon said lower recessed surface.

15. The mounting system as defined in claim 14 including a stationary, generally circular cover secured to said boat deck for protecting said bearing in spaced apart generally concentric relation relative to said rotatable pan lip.

16. The mounting system as defined in claim 14 wherein said orifice includes a recessed peripheral edge in which said bearing means is disposed.

17. The mounting system as defined in claim 16 wherein said means for securing said foot control within said pan comprises a pair of spaced apart, cooperating spacers having a segment shaped cross section adapted to center said foot control within said pan.

18. The mounting system as defined in claim 17 further comprising plate means removably associated with said pan for at least temporarily covering said foot control.

19. The mounting system as defined in claim 18 wherein said spacers comprise an offset ridge defined in said upper surface adapted to receive edges of said plate means so that when said plate means is installed, said plate means forms a substantially continuous, smooth surface with said boat deck and said upper surfaces of said spacers.

20. The mounting system as defined in claim 20 including a stationary, generally circular cover secured to said boat deck for protecting said bearing in spaced apart generally concentric relation relative to said rotatable pan lip.

* * * * *